US009422746B1

(12) United States Patent
Zhang et al.

(10) Patent No.: US 9,422,746 B1
(45) Date of Patent: Aug. 23, 2016

(54) LOCKER LOCK WITH OUTER AND INNER HOUSINGS

(71) Applicant: Digilock Asia Ltd., Kowloon (HK)

(72) Inventors: An Zhang, Shaoguan (CN); Asil T. Gokcebay, Petaluma, CA (US)

(73) Assignee: Digilock Asia Ltd., Kowloon (HK)

( * ) Notice: Subject to any disclaimer, the term of this patent is extended or adjusted under 35 U.S.C. 154(b) by 0 days.

(21) Appl. No.: 14/931,781

(22) Filed: Nov. 3, 2015

(51) Int. Cl.

| | |
|---|---|
| ***E05B 47/00*** | (2006.01) |
| ***E05B 65/02*** | (2006.01) |
| ***E05B 47/02*** | (2006.01) |
| ***E05B 65/06*** | (2006.01) |
| ***E05B 47/06*** | (2006.01) |

(52) U.S. Cl.
CPC ..... *E05B 47/0002* (2013.01); *E05B 47/02* (2013.01); *E05B 47/026* (2013.01); *E05B 47/06* (2013.01); *E05B 65/025* (2013.01); *E05B 65/06* (2013.01); *E05B 2047/0048* (2013.01); *E05B 2047/0057* (2013.01)

(58) Field of Classification Search
CPC ..... E05B 47/0001; E05B 47/0002; E05B 47/02; E05B 47/026; E05B 47/06; E05B 47/0603; E05B 2047/0014; E05B 2047/0048; E05B 2047/005; E05B 2047/0057; E05B 2047/0058; E05B 2047/0072; E05B 49/00; E05B 65/02; E05B 65/025
See application file for complete search history.

(56) References Cited

U.S. PATENT DOCUMENTS

| | | | | |
|---|---|---|---|---|
| 5,862,693 | A * | 1/1999 | Myers | E05B 47/0002 292/144 |
| 5,886,644 | A | 3/1999 | Keskin et al. | |
| 5,894,277 | A | 4/1999 | Keskin et al. | |
| 6,098,433 | A * | 8/2000 | Maniaci | E05B 47/0002 292/144 |
| 6,116,066 | A * | 9/2000 | Gartner | E05B 41/00 292/348 |
| 6,655,180 | B2 * | 12/2003 | Gokcebay | E05B 63/00 340/5.2 |
| 6,722,170 | B2 * | 4/2004 | Squier | E05B 9/08 292/DIG. 53 |
| 7,336,150 | B2 * | 2/2008 | Gokcebay | E05B 47/06 340/5.2 |
| 9,019,067 | B2 * | 4/2015 | Bryla | E05B 47/00 307/112 |
| 2003/0024288 | A1 * | 2/2003 | Gokcebay | G07C 9/00674 70/432 |

* cited by examiner

*Primary Examiner* — Christopher Boswell
(74) *Attorney, Agent, or Firm* — Thomas M. Freiburger

(57) ABSTRACT

An electronic locker lock with outer and inner housings similar to that described in U.S. Pat. No. 5,886,644 has a cable connector extending from one housing to the other. When the two housings are installed against outer and inner sides of a locker door, with the door panel sandwiched between housings, the inner housing provides a pocket for storage of the cable after pin connections have been made. In addition, a locking connection is made between the two parts of the pin connector, with a plastic spring lock, preventing disconnection while the lock is in service, and the lock allows for a range of locker door thickness.

7 Claims, 6 Drawing Sheets

LOCKER LOCK WITH OUTER AND INNER HOUSINGS

BACKGROUND OF THE INVENTION

This invention is concerned with lockers for temporary use, but also encompasses lockers for longer term use. In particular, the invention is directed to an electronic locker lock for use on such lockers.

U.S. Pat. Nos. 5,886,644 and 5,894,277, owned by the assignee of this invention describe locker locks similar to the locks disclosed herein. Those locks each include two housings, one on the outside of the door, one on the inside, secured together with the door panel sandwiched between, preferably using the standard three-hole locker door prep typically included on locker doors.

Those patents featured a pin connector without cable, the two components of the pin connector mating together as the inner and outer housings were put into place on the door. In some circumstances such a connection could be problematic, such as when different thicknesses of doors need to be accommodated. Pins of different length had to be provided, and in some cases long pins could be misdirected and deformed as the housings were put in place, preventing a proper connection.

It is therefore desirable to have a cable, such as a ribbon connector cable, extending from one of the housings, the end of the cable having a pin connector component that mates with a fixed-position opposing pin connector component on the other housing. Although this arrangement has been used on some locker door locks having inner and outer housings, the cable has presented a problem. The length of the cable must be sufficient for convenience in use for assembling the lock on the locker door, but this length must then be stowed between the housings when attached to the door. Usually the cable was simply stuffed into the small amount of space afforded by the hole through the door. With a sufficiently thick door, such as a ¾ inch wood door, the cable was jammed into the depth of the hole in a somewhat disorganized way, potentially causing damage to the cable. In some cases there has been no place to store the cable.

SUMMARY OF THE INVENTION

The electronic locker lock of the invention has outer and inner housings and is somewhat similar to that described in U.S. Pat. No. 5,886,644, but with a cable connector extending from one housing to the other. When the two housings are installed against outer and inner sides of a locker door, the inner housing provides a pocket adjacent to the door for storage of the cable after pin connections have been made.

The pocket on the inner housing provides a space for neatly doubling the cable over on itself and stowing the cable between the housings.

In addition, a locking connection is made between the two parts of the pin connector, with a plastic spring lock, preventing disconnection while the lock is in service. Prior two-housing electronic locker locks often had the problem of pin connectors being disconnected inadvertently, such as by occasional slamming of the locker door.

A further feature of the invention is in the manner the two housings engage together through the locker door. The locker door preferably has a standard three-hole locker door prep, with the cable of the electronic lock extending through a central hole of the three-hole door prep and a pair of machine screws extending through the upper and lower holes of the door prep. The outer housing has internally threaded cylinders extending back on the rear side of the outer housing and through the upper and lower holes of the door prep, and the inner housing has tubular guide recesses receiving the threaded cylinders. This allows the cylinders to extend to varying distances into the tubular recesses in order to accommodate locker doors of different thicknesses, thus different separations between the housings. The machine screws extend from a back side of the inner housing through the tubular recesses and into the internally threaded nut cylinders to secure the two housings in place on the locker door. Machine screws of different lengths can be provided.

The lock of the invention is efficiently constructed and installed and reliable and rugged in service. These and other objects, advantages and features of the invention will be apparent from the following description of a preferred embodiment, considered along with the accompanying drawings.

DESCRIPTION OF PREFERRED EMBODIMENTS

Figure 1:
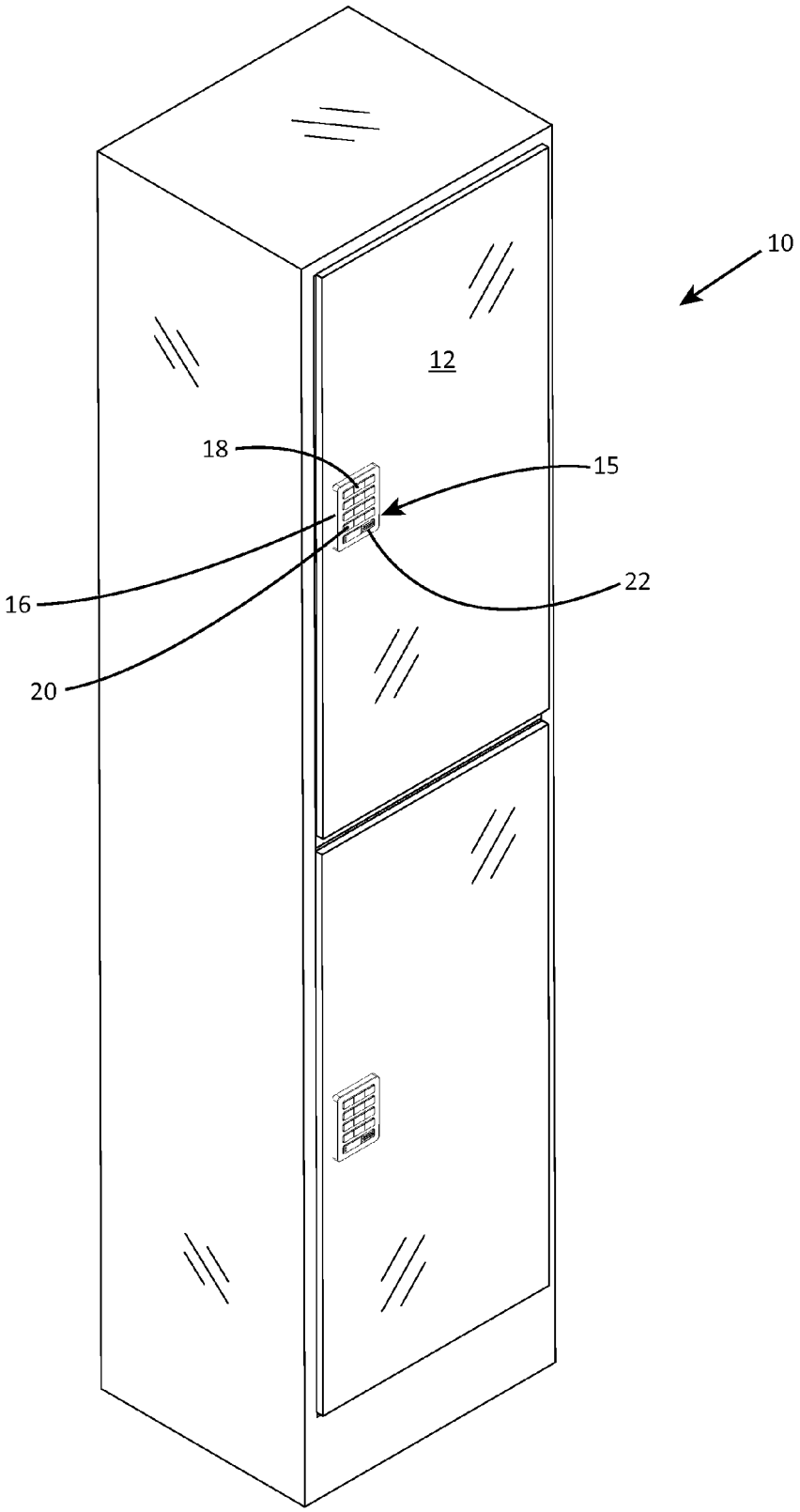
FIG. 1 is a view showing a locker door having an electronic lock according to the invention.
Figure 4:
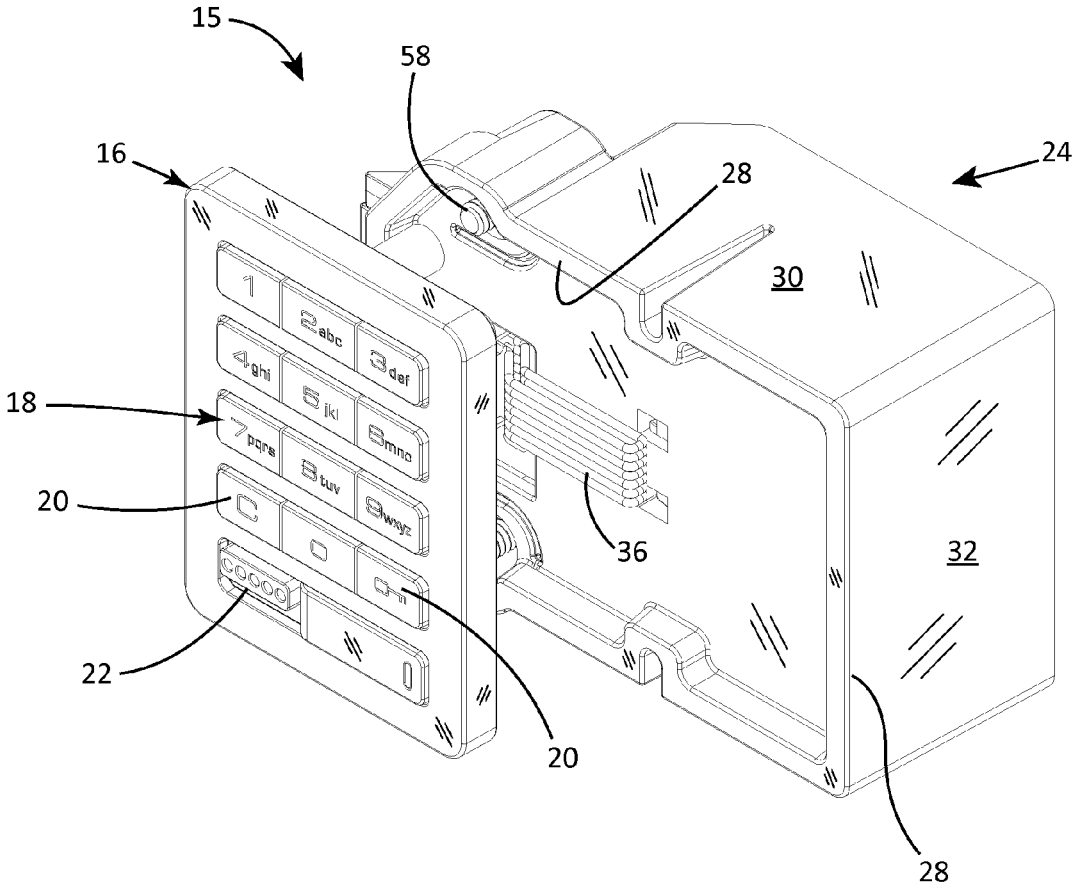
FIG. 4 is an exploded perspective view showing the inner and outer housings, without the locker door.

In the drawings, FIG. 1 shows a locker 10 with a locker door 12, and a lock 15 of the invention secured to the door. The front (outer) housing 16 is visible in FIG. 1, having an electronic access means, preferably a keypad 18 with other keys 20 for operation of the lock, and also preferably including a terminal 22 for jump power and/or programming or emergency access. FIG. 4 shows the housing 16 in better detail.

Figure 2:
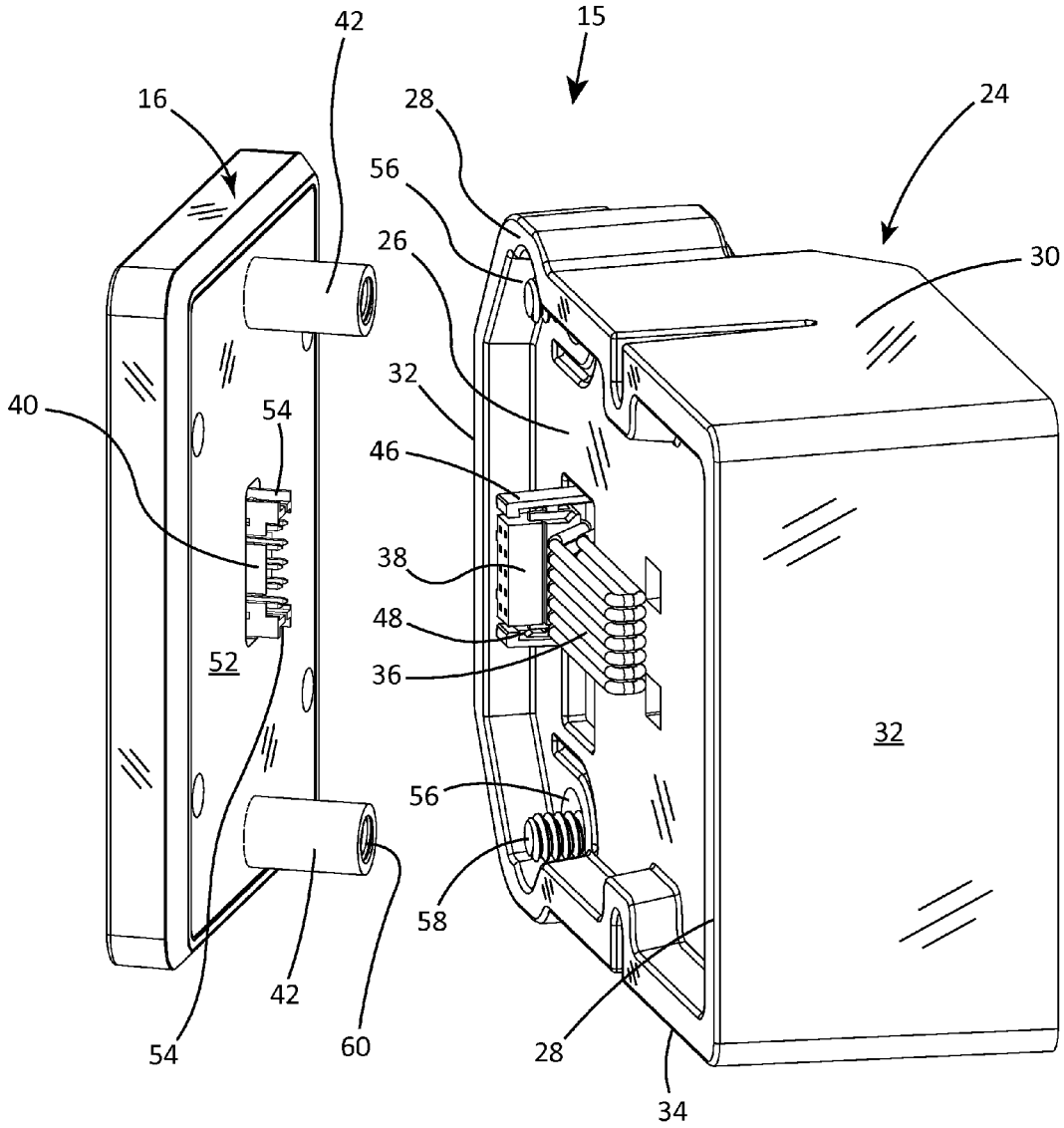
FIG. 2 is an exploded view in perspective showing the inner and outer housings of the lock.

FIG. 2 shows the lock 15 in exploded view, the front housing 16 being shown for connection with a rear housing 24. The inner housing 24 is to be installed against the inside surface of a locker door, directly behind the front housing 16. The inner housing contains an electromagnetic drive means to operate a bolt or latch, preferably a motor but this could be a solenoid as well. This housing 24 may also contain a microcontroller to operate the electronic lock, although the microcontroller could alternatively be in the outer housing 16.

Figure 3:
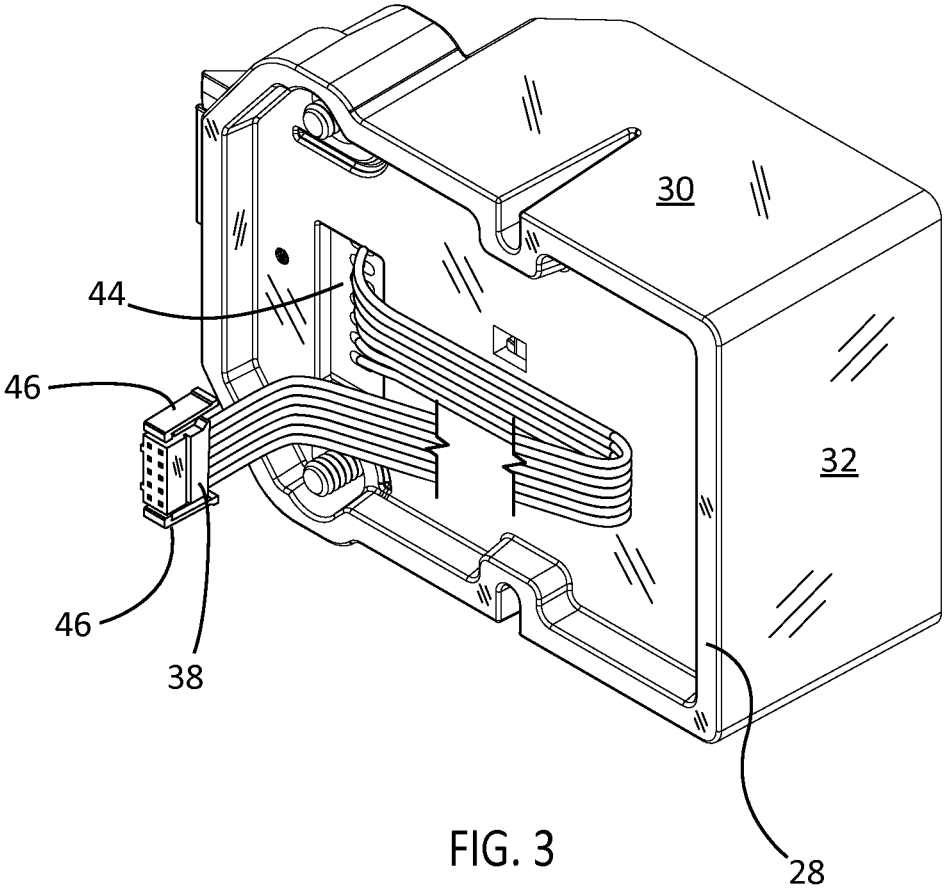
FIG. 3 is a perspective view showing the inner housing.

As discussed above, several features of the lock 15 of the invention add significantly to efficiency of installation and use, reliability and ruggedness in service. One of these features, demonstrated clearly in FIGS. 2, 3 and 4, is a pocket or recess 26 in the front side of the inner housing 24, i.e. the side of that housing facing forward, for contact against the inner surface of the locker door. This pocket or recess is formed by a protruding rim 28 extending around the periphery of the housing 24 at its forward side. As shown in the drawing, the rim 28 preferably is simply a forward extension of top, side and bottom walls 30, 32 and 34. The depth of the pocket 26 can be about ¼ inch, or in the range of about 3/16 inch to ⅜ inch.

The function of the pocket 26 is for efficient and organized stowage of an electrical cable 36 that connects electrical components of the two housings when installed on a locker. FIGS. 2, 3 and 4 all show the cable 36, which can be a ribbon connector cable. The cable 36 has an outer end with a pin/socket connector component 38, for connection to a mating component 40 on the back side of the outer housing 16, as shown. In this view the female connector (socket) is shown on the cable, at 38, while the male connector (pin) is shown fixed on the outer housing, at 40. The pin and socket connectors can be reversed in position if desired. As illustrated, the pocket 26 of the inner housing allows the electrical cable 36 to be folded over on itself for stowage, as the two housings are brought together against the inner and outer sides of a locker door.

The pin/socket connection is made before housings have been secured, and with the cable 36 extended, generally as indicated in FIG. 3. At this point the outer housing 16 can be in place (but not secured) on the outside of the locker door, via upper and lower internally threaded cylinder posts 42 that have been positioned through holes in the locker door. These holes may be part of a three-hole standard locker door prep.

After connection, the cable 36 is positioned as shown in FIG. 3, then as shown in FIGS. 2 and 4 as the two housings are secured together via the pin/socket connector 38, 40. The excess length of the cable 36 is stowed within the pocket 36, without crimping, pressure or sharp bends.

Figure 5:
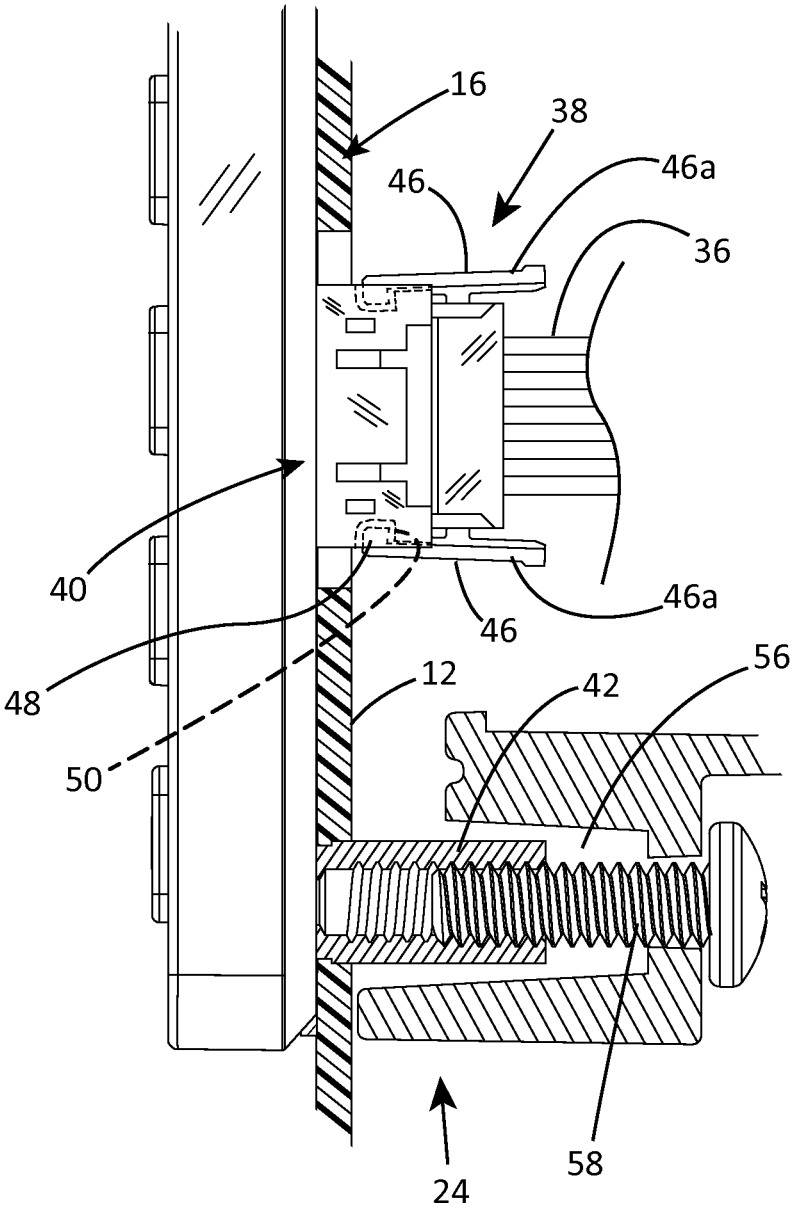
FIG. 5 is a cross section view showing the connection made between the two housings when secured to the door.

As seen particularly in FIG. 3, the cable in this embodiment emerges from a cable well or depression 44 which extends deeper into the inner housing as shown. This well 44, if present, is directly opposed to the position of the outer housing's pin connector element 40. When the connection has been made and the housings 16 and 24 are secured to the locker door, the pin/socket connector element 38 can extend back slightly into the well 44 if needed. This is seen in FIGS. 2, 4 and 5.

Figure 6:
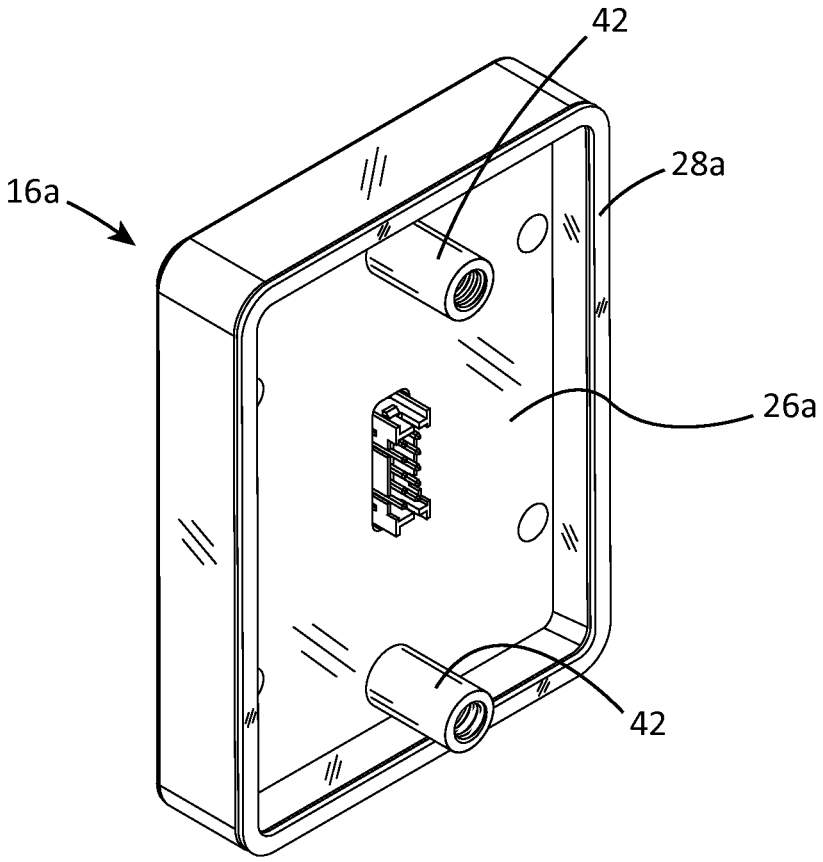
FIG. 6 is a perspective view showing an alternative embodiment.

FIG. 6 shows a variation in which a cable-storing pocket **26*a* is formed by a rim 28*a* at the back of the outer housing 16*a*, rather than on the inner housing. The cable can still extend from the inner housing (not shown) in this case, although it could originate in either housing, provided space (such as the well or depression 44 in FIG. 3) is provided, preferably in the inner housing, to accommodate the two connected pin/socket connector elements 38 and 40. The pocket 26*a*** provides some of the space.

Another important feature, as explained above, is the pin/socket connector lock that retains the two pin/socket connector elements together, resisting separation even under repeated locker door slamming. A pair of plastic springs or spring arms 46 are provided on one of the connector elements, here shown at top and bottom of the element 38 at the end of the electrical cable. These spring arms 46, preferably integral with the plastic body of the pin connector element 38, each have a small barb 48 at the outer end as shown, for engagement in a recess or over a ledge or edge (see FIG. 5) provided on the opposing pin/socket connector element 40 that is secured in the outer housing 16. The cross section view of FIG. 5 shows, somewhat schematically, the two connector components 38 and 40, the spring arms 46 and the engagement of the barbs 48 each over a ledge 50 that forms part of the outer housing's fixed pin/socket connector element 40. Note that the spring arms can be released by pinching back ends **46*a*** toward one another, which spreads apart the barb ends.

As indicated in the drawings, the connector component 40 preferably extends out rearwardly somewhat from the back wall 52 of the outer housing, and it may include top and bottom tracks or grooves 54 as shown in FIG. 2 to guide the plastic spring arms 46 as the two connector elements are mated. The locker door 12 is also seen in FIG. 5, in this case shown as a sheet metal door which is relatively thin.

Although plastic spring locks generally similar to the illustrated locking device have been known for securing together pin connectors in other types of devices, they have not been applied to electronic locker locks having inner and outer housings as in the invention. This has caused problems of occasional dislodging of the connection, whereby the locker lock is rendered inoperable, and a locker door may have to be forced open.

A third important feature of the invention involves the internally threaded cylindrical posts 42 of the outer housing, discussed above. The inner housing 24 includes generally tubular guideways 56, preferably formed by the inside of the housing walls, to receive the cylindrical posts 42. This provides for a smooth and accurate alignment of the inner and outer housings as they are moved together, and also helps provide for different thicknesses of locker doors that result in variation of distances between the two housings when assembled. Upper and lower machine screws 58 are inserted into the inner housing from a back side, not shown in these views. The machine screws engage with the threaded interior 60 of each post 42. With considerable thread length in each cylindrical post 42, a range of different housing separations can be accommodated. Machine screws of different lengths can be provided, but even a single length of machine screw will accommodate a good range of separation distances, as can be envisioned from FIG. 2.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

What is claimed is:

1. In combination with a locker for temporary storage of a user's articles, the locker having a door and a movable latch positioned to secure the door when in latched position and to unlock the door when moved to an unlatched position, an electronic lock for controlling the latch, comprising:

an inner housing and an outer housing, the inner housing being secured at the inside of the door and the outer housing being secured at a directly opposed position on the outside of the door such that the door is sandwiched between the two housings, with a cable extending from one of the housings and carrying at its end one component of a pin/socket connector, the cable extending through an opening in the door, and the other of the housings having a mating component of the pin/socket connector, a pocket formed in one of the housings, the pocket being at a side of the one housing adjacent to the door panel, providing an enclosed space for between the one housing and the door panel within which excess length of the cable is fully stowed when the pin/socket connector is assembled together, electronic access means in the outer housing, for receiving an access code input by a user, electromagnetic drive means in the inner housing, connected to the latch so as to control the position of the latch, microcontroller means connected between the electronic access means and the electromagnetic drive means, for causing the drive means to change the position of the latch when a preselected access code is received by the electronic access means, and a battery in one of the housings, connected to supply power to the electronic lock.

2. The combination defined in claim 1, wherein the pocket in the one housing comprises a rim extending around a periphery of the one housing so as to be engageable against the door panel, and providing the pocket as a recess formed by the rim and defining said enclosed space.

3. The combination defined in claim 2, wherein the rim forms a recess of about ¼ inch as said pocket.

4. The combination defined in claim 1, further including a plastic pin/socket connector lock formed on one of the components of the pin/socket connector to engage with the other component of the pin/socket connector when the connection is made and to retain the pin/socket connector together.

5. The combination defined in claim 4, wherein the plastic hinge pin/socket connector lock includes a pair of spring arms with a barb at an end of each arm, to engage with the other pin/socket connector component.

6. The combination defined in claim 1, wherein the one housing having the pocket is the inner housing.

7. The combination defined in claim 1, wherein the locker door has a standard three-hole locker door prep, the cable of the electronic lock extending through a middle hole of the three-hole door prep and a pair of machine screws extending through the upper and lower holes of the three-hole door prep, the outer housing having internally threaded cylinders extending back on the rear side of the outer housing and through the upper and lower holes of the door prep, and the inner housing having tubular recesses receiving the internally threaded cylinders such that the cylinders can extend to varying distances into the tubular recesses in order to accommodate locker doors of different thicknesses, and the machine screws extending from a back side of the inner housing through the tubular recesses and into the internally threaded cylinders to secure the two housings in place on the locker door.

* * * * *